United States Patent [19]

LaConte

[11] Patent Number: 4,798,061

[45] Date of Patent: Jan. 17, 1989

[54] PRE-COOLER APPARATUS AND METHOD FOR INCREASING ICE MAKER OUTPUT

[76] Inventor: Dennis B. LaConte, 113 Spring Lake Dr., Debary, Fla. 32713

[21] Appl. No.: 168,400

[22] Filed: Mar. 15, 1988

[51] Int. Cl.[4] ..... F25C 1/00

[52] U.S. Cl. ..... 62/348

[58] Field of Search ..... 62/348, 66

[56] References Cited

U.S. PATENT DOCUMENTS

| | | | |
|---|---|---|---|
| 1,267,795 | 5/1918 | Ophuls | 62/348 X |
| 2,585,021 | 2/1952 | Lessard et al. | 62/348 X |
| 2,775,100 | 12/1956 | Howe | 62/348 |
| 2,949,752 | 8/1960 | Bayston | 62/348 X |
| 3,779,029 | 12/1973 | Larriva | 62/348 X |
| 4,338,794 | 7/1982 | Haases Jr. | 62/348 |

*Primary Examiner*—William E. Tapolcai

*Attorney, Agent, or Firm*—Edward M. Livingston

[57] ABSTRACT

An apparatus and method for increasing the ice production of current ice makers. The apparatus is used in conjunction with a pre-existing beverage system to cool the water input to an existing ice maker. In this apparatus and method, an electrically-driven pump circulates water through tubing immersed in the ice bank of the beverage system to supply cool water to the input line to the ice maker. In this manner, by pre-cooling the water supplied to the ice maker, the poundage of ice output per day of an existing ice maker can be increased substantially without additional cost, thereby reducing the need to purchase supplementary crushed ice or additional ice makers to meet requirements for additional ice. This apparatus and method is especially useful in fast-food restaurants during summer months when the output of ice machines is acutely insufficient to meet demand.

4 Claims, 1 Drawing Sheet

PRE-COOLER APPARATUS AND METHOD FOR INCREASING ICE MAKER OUTPUT

BACKGROUND OF THE INVENTION

This invention relates to ice-making devices and more particularly to a supplementary apparatus which increases the ice-making capacity of existing ice-making machines.

In fast-food restaurant operations, the need for ice used in soft drinks and other similar purposes is particularly great, especially during the hot summer months. Most often, current ice-making machines do not provide sufficient output of ice to fulfill such requirements and fast-food restaurants must buy additional ice in large quantities to supplement the ice provided by ice makers, which is often cumbersome and can add significantly to operating expenses. Thus, there is a great need for an apparatus which can increase the rate and quantity of ice production of current ice-making machines already installed in such restaurants.

Although some prior patented ice-making devices have used multiple refrigeration units in clustered formation to pre-cool water, none has used an add-on apparatus and method as in the instant invention. For instance, U.S. Pat. Nos. 2,775,100 by Howe on Jan. 25, 1956, and 2,921,447 by Gottschalk on Jan. 19, 1960, show devices which use water from the discharge overflow of an ice maker to pre-cool incoming city water before it enters the freezing portion of the ice maker. Similarly, U.S. Pat. No. 2,730,865 by Murdock on Jan. 17, 1956, discloses an ice-making machine which precools the water in a reservoir before going into the freezing section of the ice maker. U.S. Pat. No. 3,779,029 by Larriva on Dec. 18, 1973, shows a stacked refrigerator booster used to pre-cool water. Another U.S. Pat. No. 3,267,688 by Carpigiani on Aug. 23, 1966, shows pre-cooling circuits for ice cream machines. Other ice-making apparatuses such as U.S. Pat. Nos. 4,459,824 by Krueger issued July 17, 1984, and 2,836,038 by Morgan on May 27, 1958, are representative of what are currently in use as ice makers.

All the above-referenced patented apparatuses are integral parts of the ice makers themselves. Thus, their use would require ice makers currently in place in millions of fast-food restaurants to be replaced at great expense. Some of the devices described above require that cool water from the ice maker itself be used to pre-cool other water, which further decreases the temperature of the water in the ice maker itself.

On the other hand, the instant apparatus can be added to current systems at nominal expense and still provide more and faster ice production than such systems and with less electrical energy than the clustered refrigeration units. The instant apparatus is used in conjunction with pre-existing beverage systems. A recirculation pump and motor in the instant invention is mounted near the beverage system. Then insulated flexible tubing is run from the pump to coiled tubing made of a highly conductive metal such as copper, which is submerged in the ice bank of the beverage system. Then insulated flexible tubing is attached to the discharge side of this copper tubing which enters the ice maker water feedline. A U-tube is provided in the ice maker feedline to return unused water back to the recirculating pump. Thus, a continuous flow of pre-cooled water having a temperature near freezing, approximately 34 degrees Fahrenheit, is obtained. Since this water is much cooler than the temperature of city water used directly in most ice-making machines, the ice-making cycle time is shortened considerably, thereby allowing approximately a 40 to 45 percent increase in ice production.

SUMMARY OF THE INVENTION

The primary object of the invention is to increase the ice output of current ice makers.

A second object of this invention is to provide such an apparatus which is an add-on or supplements current ice makers so that the replacement of current ice-making machines is not required.

Another object of the instant invention is to provide a device which is inexpensive to purchase, easy to install and inexpensive to operate.

The instant invention accomplishes the above and other objects by providing an apparatus which precools water before it goes to the ice maker by using the ice bank of a pre-existing, self-contained beverage system and continuously recirculating the water to the ice maker. The apparatus is an add-on device, not requiring the replacement of current ice-making machines, because it consists of a separate recirculating pump connected by flexible tube to a coiled tubing, made of conductive metal such as copper, immersed in the beverage system ice bank. A flexible tube then connects the discharged end of the coiled tube to the water feedline of the ice maker. The apparatus has few parts and simply hooks into the water inlet line before the ice maker. It is inexpensive to operate since there is only one recirculator pump and there is no heat exchanger, compressor or refrigeration unit since it uses the ice bank of the excess refrigeration of the pre-existing beverage system to pre-cool the water. Thus, the power usage is also reduced substantially.

Other objects, advantages and features of the invention will become readily apparent from the following detailed description of the specific embodiments thereof when read in conjunction with the accompanying drawings.

BRIEF DESCRIPTION OF THE DRAWINGS

The drawings appended to this application are as follows.

DETAILED DESCRIPTION OF THE PREFERRED EMBODIMENT

Figure 1:
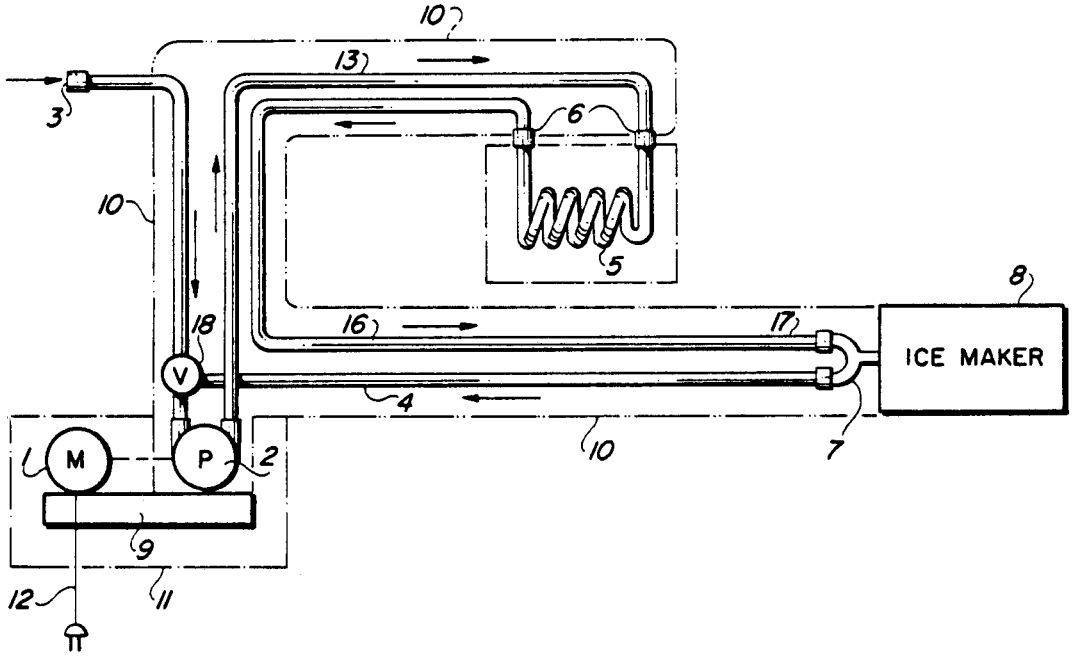
FIG. 1 is a schematic diagram outlining the components of the apparatus.

Referring now in detail to the drawings, FIG. 1 illustrates in schematic form the components of the instant invention. In the preferred embodiment, the apparatus consists of an electric motor 1 driving a pump 2 mounted on an optional stand 9. The pump 2 is connected to an incoming water line 3 through which city water having an ambient temperature is provided. The incoming water line 3 would preferrably be made of flexible plastic tubing to allow flexibility in the installation of the apparatus. The pump 2 forces the water through an outlet line 13, which also may be flexible tubing, to coiled tubing 5 which is immersed in the ice bank 15 of the pre-existing, selfcontained beverage unit 14. The coiled tubing 5 is made of conductive material such as copper, in order to provide a better exchange of heat from the ambient water being pumped through the ice bank 15. After being circulated through the coiled tubing 5, the now cool water passes through a flexible tubing 16 which is connected to an ice maker water feedline 17. As part of the instant invention, a U-tube 7 is placed in said ice maker feedline 17. The U-tube 7 allows ice maker 8 to take as much of the pre-cooled water as needed in any particular freezing cycle and the excess cooled water to be diverted through a flexible return water line 4, back to the pump inlet line 3 and the pump 2 for recirculation and re-cooling. This continual recirculation of the water throughout the system maintains cool water for the ice maker 8 for its next ice-making cycle. Insulation, indicated by 10 in FIG. 1, surrounds all tubing and further preserves the low temperature of the water.

Figure 2:
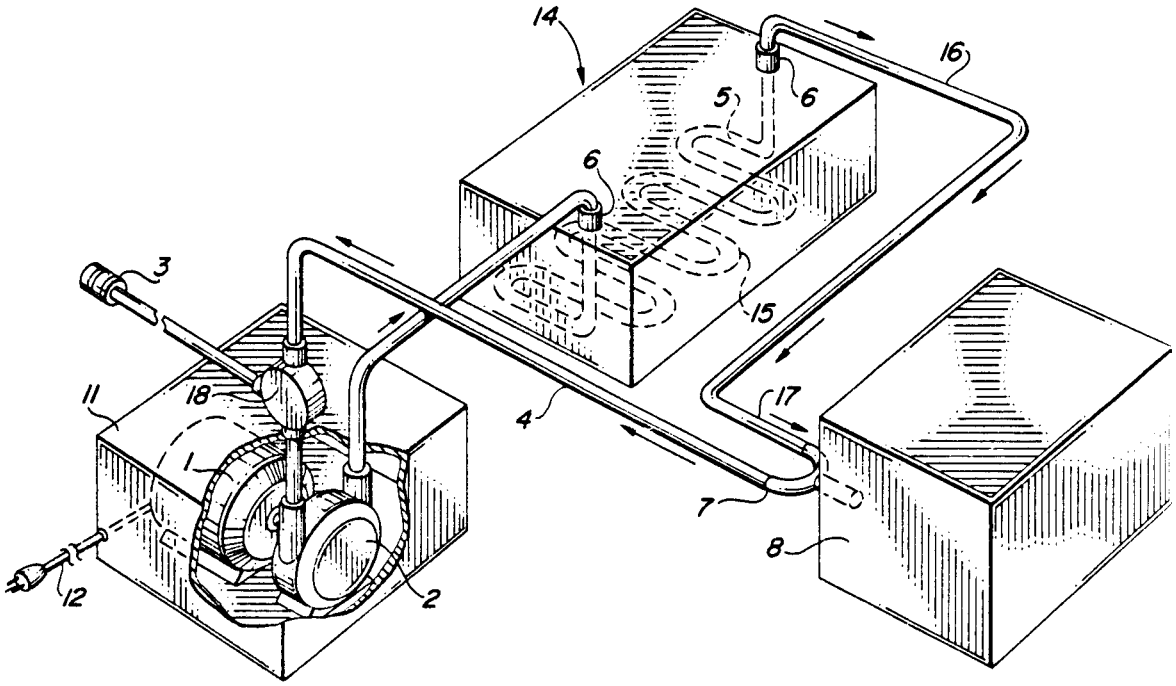
FIG. 2 is a partial cut-away perspective view of the apparatus without the insulation.

In FIG. 2, the apparatus is shown in partial cut-away perspective view without insulation. In this drawing, the motor 1 and pump 2 are shown enclosed in a protective box 11. An electrical cord and plug 12 connect the two sources of electrical power. The water inlet line 3 delivers city water at ambient temperature to the pump 2, driven by a motor, where it is circulated through a flexible water line 13 connected by a connector 6 to a coiled tube 5 immersed in the ice bank 15 of a pre-existing, self-contained beverage system 14. As indicated hereinabove, the coiled tube 5 should be made of conductive material such as copper tubing. At its discharge end, the coiled tube 5 is connected at 6 to a flexible water line 16 which may be part of the water feedline 17 of the ice maker 8. The ice maker 8 takes the pre-cooled water as needed and the remainder is reverted by the U-tube 7 through the flexible line 4 and ultimately to the pump 2 for recirculation and re-cooling. A three-way valve 18 can be provided at the point where the ice maker outlet line 4 taps into the incoming water line 3.

When the system is operating and the water continually circulates throughout the system, it will provide water to the ice maker at a temperature near freezing, approximately 34 degrees Fahrenheit. It has been shown that by using this apparatus and method of pre-cooling water that the output of standard ice makers can be increased at least 40 to 45 percent in terms of the poundage of ice output per hour.

Thus, as described in detail above, it should be apparent that there has been provided a new, useful and nonobvious apparatus and method to increase the output of current ice makers. The apparatus utilizes the ice bank, that is, the excess refrigeration of a pre-existing, self-contained beverage system, to provide pre-cooled water to the ice maker to increase substantially the quantity and rate of ice production. A further advantage of the instant apparatus and method is that it is an add-on to current ice makers and does not require the replacement of current ice makers or the installation of redundant refrigeration systems. The instant apparatus has few parts, is inexpensive and is simple to install. Current fast-food restaurants will find the instant invention most useful in their operations, particularly during hot summer days.

While specific embodiments of the invention have been described in detail hereinabove, it should be understood that various modifications may be made from the specific details described hereinabove without departing from the spirit and scope of the invention as set forth in the appended claims.

Having described in detail my invention, I claim the following:

1. An apparatus for pre-cooling water for ice makers to be used in combination with a pre-existing, self-contained beverage system having an ice bank, said apparatus comprising:

an electrically-driven water pump having an inlet line from the ambient water supply and an outlet line;

a coiled tube immersed in the ice bank of the beverage system, which is connected at its intake end to the outlet tube from the water pump, and at its discharge end to a water feedline of an ice maker; and a return water line from the ice maker to the inlet tube of the water pump for recirculation of the water.

2. The apparatus of claim 1 wherein a U-tube connects the water feedline of the ice maker to the return water line of the pump tube to provide continual recirculation of the water when the ice maker is not drawing water.

3. The apparatus of claims 1 or 2 wherein the return water line from the ice maker contains a three-way valve.

4. A method of utilizing pre-cooled water to increase the output of an existing ice maker comprising:

intaking water from ambient water supply to a water pump;

pumping said water through a water tube immersed in an ice bank of a pre-existing, self-contained beverage system to cool the water;

providing the cooled water from the beverage system to an ice maker for use in producing ice; and recirculating water not drawn by the ice maker back to the water pump for recirculation.

* * * * *